US006126309A

United States Patent [19]

Bettelini et al.

[11] Patent Number: 6,126,309

[45] Date of Patent: Oct. 3, 2000

[54] SIMPLIFIED TIME-SETTING DEVICE FOR A TIMEPIECE

[75] Inventors: Marco Bettelini, Prêles; Björn Kjelsberg, Bienne, both of Switzerland

[73] Assignee: ETA SA Fabriques d'Ebauches, Grenchen, Switzerland

[21] Appl. No.: 09/094,105

[22] Filed: Jun. 10, 1998

[30] Foreign Application Priority Data

Jun. 12, 1997 [CH] Switzerland ..... 1425/97

[51] Int. Cl.[7] ..... G04B 18/00

[52] U.S. Cl. ..... 368/185; 368/190

[58] Field of Search ..... 368/145, 146, 368/190–195, 308, 319

[56] References Cited

U.S. PATENT DOCUMENTS 607,144 7/1898 Teske ..... 368/147
4,853,909 8/1989 Shoji et al. ..... 368/190
4,932,011 6/1990 Schwartz .
5,083,300 1/1992 Schwartz ..... 368/185

FOREIGN PATENT DOCUMENTS 3544743 6/1987 Germany .
15953/64 9/1966 Switzerland .

*Primary Examiner*—Bernard Roskoski
*Attorney, Agent, or Firm*—Sughrue, Mion, Zinn, Macpeak & Seas, PLLC

[57] ABSTRACT

The time-setting device includes a stem (8) capable of driving by friction a motion work wheel (29). The stem (8) ends in a knob (31) which rests against an annular flange (32) made under the motion work wheel. When the stem (8) is in a pushed in position, the knob runs idle. When this stem is pulled out, the knob drives the motion work to set the time of the hour (23) and minute (22) hands.

6 Claims, 5 Drawing Sheets

SIMPLIFIED TIME-SETTING DEVICE FOR A TIMEPIECE

BACKGROUND OF THE INVENTION

The present invention relates to a time-setting device for a timepiece, this device including a time-setting stem capable, via a crown topping one of its ends, of being set in a first neutral pushed in position or in at least a second pulled out position for which the stem co-operates with a motion work comprising a wheel and a pinion to allow time-setting of the hour and minute hands.

Such an arrangement has been proposed numerous times. The most common form uses a sliding pinion capable of meshing, via a lever and pull-out piece mechanism, onto an intermediate wheel meshed with a minute wheel. This arrangement, although widely used, is relatively complex and expensive and requires a large number of parts.

One has sought to simplify this time-setting system by reducing the number of necessary parts. For example, the document EP-B-0 261 243 (=U.S. Pat. No. 4,862,434) discloses a time-setting device using not a sliding pinion but a fixed pinion, said pinion having nonetheless a contrate toothing directly meshing with the motion work wheel. Driving of this pinion by the stem is achieved in the following manner: the stem passes through the pinion. It has a first circular cross-section of slightly smaller dimension than the bore of the pinion, so that the stem rotates freely in the pinion when it is in the pushed in neutral position. The same stem also has a second circular cross-section, following the first, of slightly larger dimension than the bore of the pinion, this second cross-section wedging itself in said bore when the stem is in the pulled out position. In this pulled out position, the stem thus drives the pinion, then the motion work wheel and finally the hands of the timepiece for time-setting.

SUMMARY OF THE INVENTION

The arrangement which has just been described thus already includes a significant simplification with respect to the conventional arrangement. However, there still exists a contrate toothing and the difficulty of accurately fitting the pinion bore on the cross-section of the stem. The present invention avoids these drawbacks, first by removing the pinion, then by providing parts which do not require very high precision machining.

In order to do this, in addition to satisfying the preliminary description given in the first paragraph of this description, the time-setting device according to the invention is characterized in that the other end of the stem is arranged to rest upon a peripheral zone of the motion work wheel when the stem is pulled out in the second position, the motion work wheel being then able to be driven by friction when the stem is actuated in rotation.

The present invention will now be described in detail on the basis of an embodiment given by way of example and illustrated by the drawings, in which:

DESCRIPTION OF PREFERRED EMBODIMENTS

Figure 1:
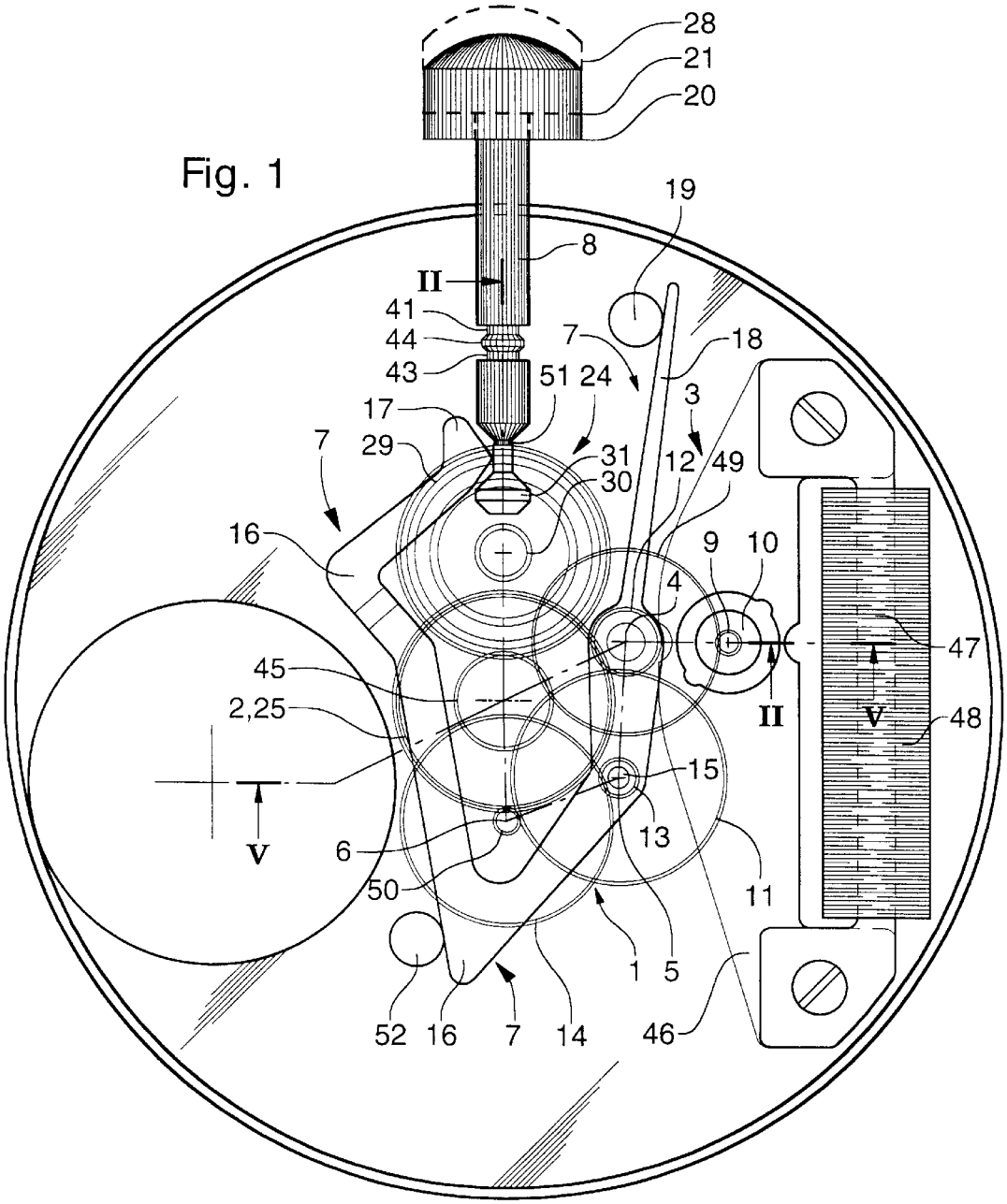
FIG. 1 is a plan view of the device of the invention, shown with the stem pushed in the neutral position, the hour and minute hands being driven by a motor and uncoupled from the time-setting stem.
Figure 2:
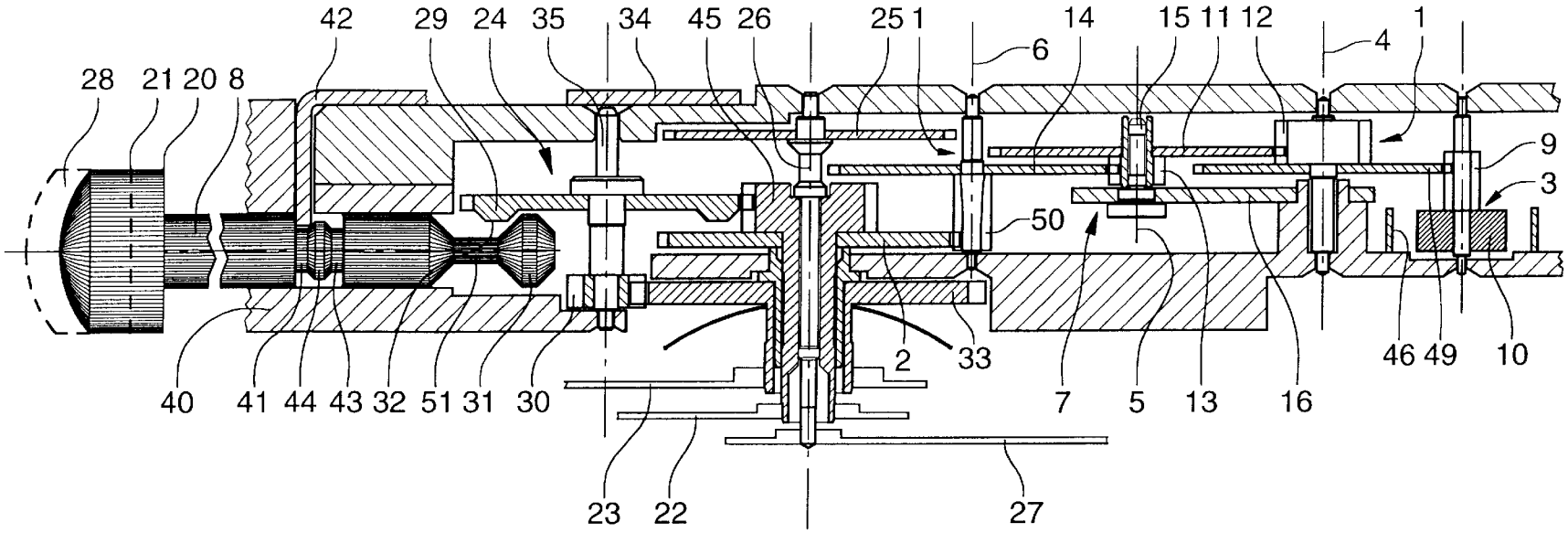
FIG. 2 is a cross-section along the line II—II of FIG. 1.
Figure 3:
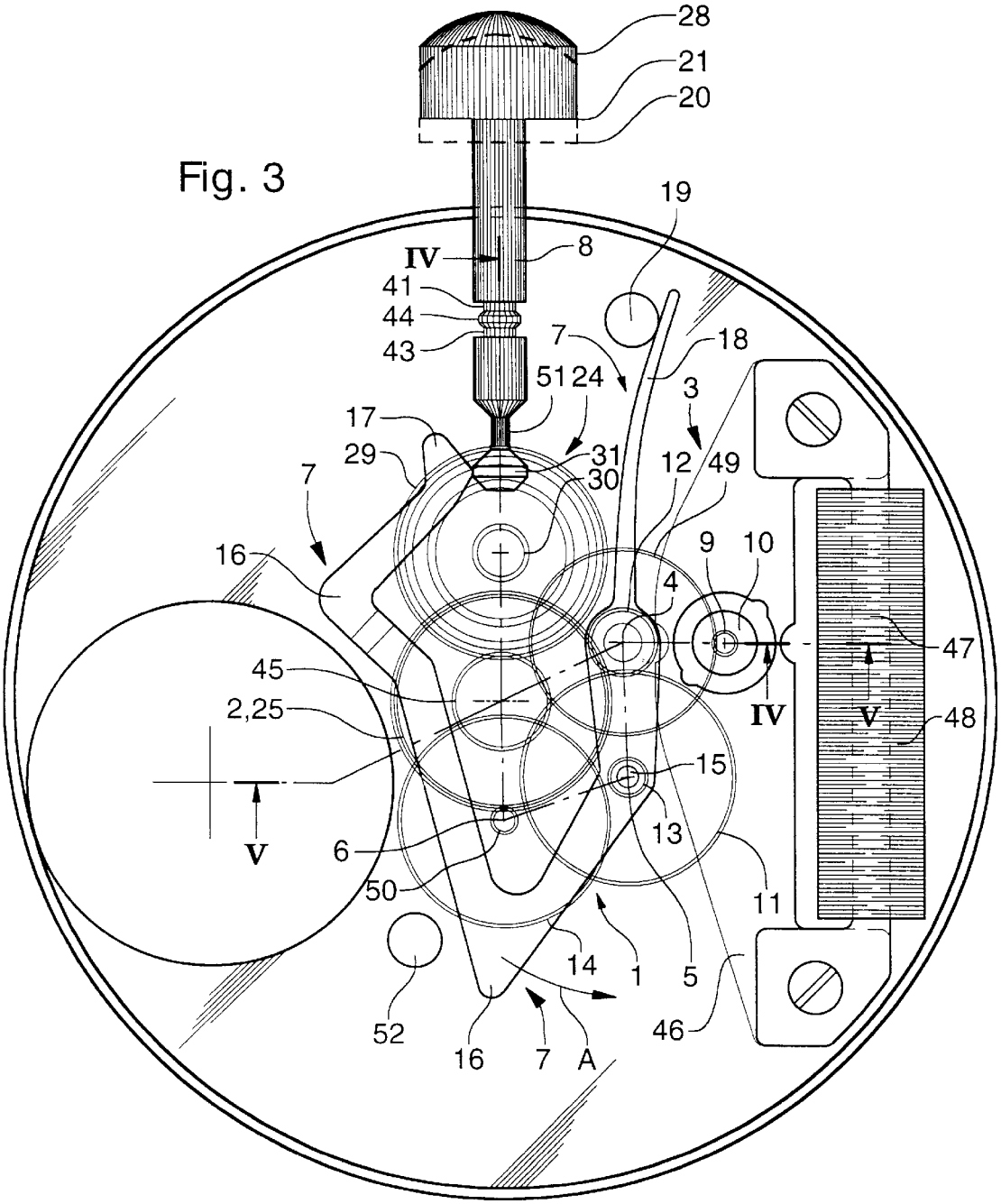
FIG. 3 is a plan view of the device of the invention, shown with the stem in the pulled out position, the hour and minute hands being driven by the time-setting stem and uncoupled from the motor.
Figure 4:
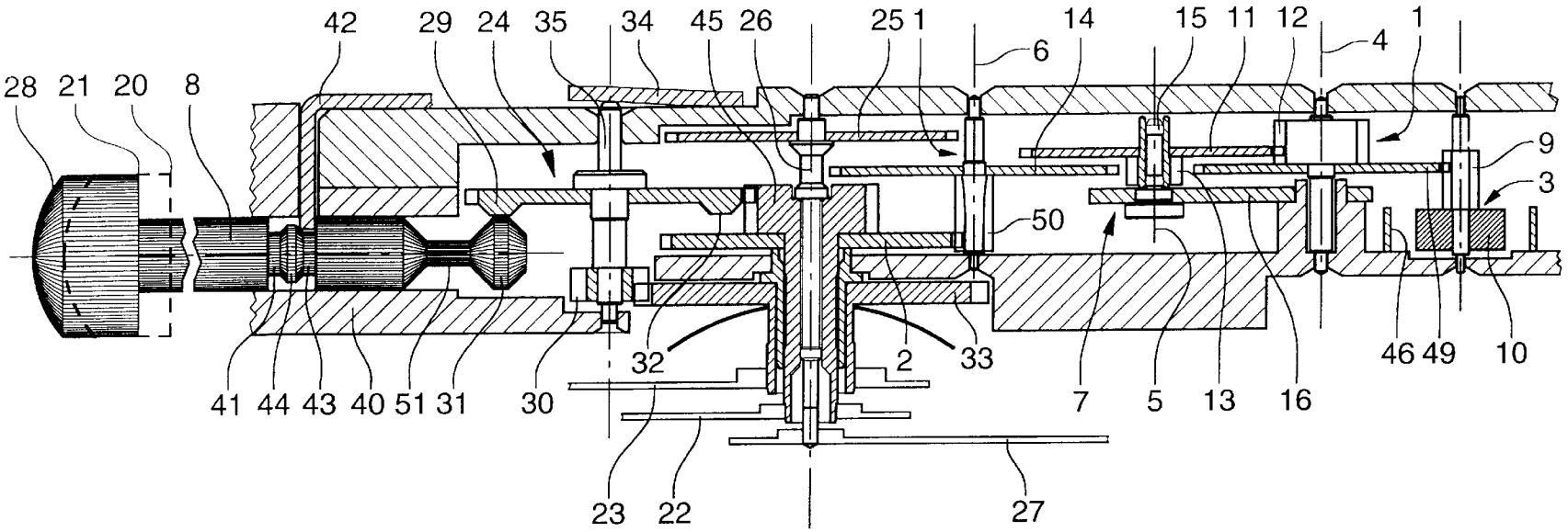
FIG. 4 is a cross-section along the line IV—IV of FIG. 3.

FIGS. 1 to 4 show how the timepiece time-setting device is made. This device includes a time-setting stem 8. This stem is topped at one of its ends by a crown 28 which allows the stem to be manipulated by fingers. The stem may be set in a first pushed in neutral position 20 as is shown in FIGS. 1 and 2. In this neutral position, the stem has no action on the motion work 24 of the timepiece. If it is driven in rotation, it thus runs idle. From this pushed in position, stem 8 may be pulled out to occupy the position illustrated by FIGS. 3 and 4. In this pulled out position 21, stem 8 co-operates with a motion work 24 including a wheel 29 and a pinion 30 attached to a shaft 35 to allow time-setting of the hour 23 and minute 22 hands. FIGS. 2 and 4 show particularly well that the end of stem 8 opposite the end topped by crown 28 is arranged to rest upon a peripheral zone 32 of motion work wheel 29 when stem 8 is pulled out in second position 21. At this moment, motion work wheel 29 may be driven by friction by stem 8 when this stem is actuated in rotation.

It will be understood that in the pulled out or time-setting position of stem 8, it is indispensable to disconnect hour and minute hands 23 and 22 from motor 3 which normally drives them to display the time.

FIGS. 1 to 4 show such a disconnecting device inserted in a timepiece gear train 1, this train driving a minute wheel 2 from a driving element 3. The Figures show that gear train 1 includes a plurality of wheels and pinions 4, 5 and 6 disposed in a chain and meshing with each other. This chain includes a wheel and pinion 5 able to be disconnected from at least one of the other wheels and pinions (from wheel and pinion 6 in the embodiment illustrated in the Figures) via the action of a lever 7 controlled by time-setting stem 8 to interrupt the chain and stop minute wheel 2. FIGS. 2 and 4 show disconnectable wheel and pinion 5 respectively connected to and disconnected from gear train 1. It is important to note here that disconnectable wheel and pinion 5, when it is actuated by lever 7, undergoes a movement of translation with respect to the other wheels and pinions 4 and 6. Indeed, the axes about which all wheels and pinions 4 and 6 rotate remain substantially parallel to each other.

An embodiment first of the time-setting device including the time-setting stem and the motion work associated therewith, then the disconnecting device inserted in the gear train connecting the motor to the hour and minute display will now be described in detail.

The time-setting device

FIGS. 1 to 4 show that the timepiece is fitted with a stem 8 topped by a crown 28 which facilitates manipulation of the stem. This stem may be disposed in a first pushed in position 20 (FIGS. 1 and 2) or in a second pulled out position 21 (FIGS. 3 and 4). Stem 8 is guided into a plate 40 and has a first groove 41 in which a positioning spring 42 engages when said stem is in its first pushed in position, and a second groove 43 in which the same spring 42 engages when the stem is in its second pulled out position. Grooves 41 and 43 are separated by a flange 44.

The other end of stem 8, that opposite to crown 28, has a knob 31. Reference 24 designates the motion work which includes a shaft 35, a wheel 29 and a pinion 30. In a peripheral zone of motion work wheel 29 and more precisely under the latter, there is an annular flange 32 on which knob 31 of stem 8 rests when this stem is in its second pulled out position (FIG. 4). Thus, in this pulled out configuration, when stem 8 is actuated in rotation, knob 32 is driven by friction and with it the whole motion work 24. Since motion work wheel 29 meshes with a cannon-pinion 45 which carries, in addition to a minute wheel 2, a minute hand 22 and since the motion work pinion 30 meshes with a cannon wheel 33 carrying an hour hand 23, it is understood that when stem 8 is actuated in rotation, wheel 29 and pinion 30 are driven which in turn drive respectively minute hand 22 and hour hand 23, which allows time-setting thereof.

In the pushed in neutral position (FIG. 2), knob 31 is released from flange 32 as well as from motion work wheel 29 which it does not touch. In this pushed in position, the stem thus runs idle if it is driven in rotation.

As was indicated hereinbefore, in order to drive wheel 29 from knob 31 pressure must be exerted on the wheel for flange 32 to be driven by knob 31. This may be achieved by raising wheel 29 when stem 8 is pulled into the second position. As a matter of fact, when one passes from the situation shown in FIG. 2 (stem pushed in) to the situation shown in FIG. 4 (stem pulled out), knob 31 raises wheel 29 against the return force of a spring 34 which, in this embodiment example, pushes on shaft 35 of motion work 24. Spring 34 presses on the motion work wheel with well determined force in order to assure the desired friction driving of wheel 29. Good contact is then assured between flange 32 and knob 31. It is to be observed that when being raised, wheel 29 and pinion 30 always remain meshed with cannon-pinion 45 and cannon-wheel 33 respectively.

Good contact between the knob and flange is not limited to the example which has just been described. For example, the return spring could be controlled by the stem at the moment when it is pulled out. This spring would then push on the shaft to prevent it from being raised, the wheel always remaining in a same plane.

It should be noted here that fitting an annular flange, made on a motion work wheel, with teeth, this toothed flange meshing with a knob which is also toothed, has already been proposed. Such an embodiment is very expensive due to cutting of the teeth and would thus not be suitable for an inexpensive timepiece.

The time-setting device which has just been described differs from the aforecited document EP-B-0 261 243, first in that it does not include any contrate pinions, then in that it does not require extreme precision to drive by friction two parts co-operating with each other.

As is seen particularly well in the plan views of FIGS. 1 and 3, when stem 8 is disposed in second pulled out position 21, knob 31 actuates a lever 7 which interrupts the time movement of hour hand 23 and minute hand 22 by uncoupling or disconnecting a wheel and pinion 5 inserted in a gear train 1 connecting motor 3 to minute wheel 22 of the timepiece. This disconnecting device will now be described in detail.

The disconnecting device

As was seen hereinbefore and as FIGS. 1 to 4 clearly show, the disconnecting device includes a wheel and pinion 5 able to be disconnected from a gear train 1 including a plurality of wheels and pinions 4 to 6 arranged in chains, this wheel and pinion 5, when it is actuated by a lever 7 controlled by time-setting stem 8, undergoing a movement of translation with respect to the other wheels and pinions 4 and 6, the axes of all the wheels and pinions remaining substantially parallel to each other.

Gear train 1 in question here connects a motor 3 activated by time pulses to a minute wheel 2 which carries the minute hand 22. Motor 3 is preferably of the stepping type including a stator 46, a core 47 surrounded by a coil 48 and a magnetised rotor 10 whose shaft carries a pinion 9. As is seen in FIGS. 1 to 4, gear train 1 includes first an intermediate wheel and pinion 4 meshed with pinion 9 carried by rotor 10 of motor 3, then disconnectable wheel and pinion 5 meshed with said intermediate wheel and pinion 4 and a third wheel and pinion 6 meshed with said disconnectable wheel and pinion 5, this third wheel and pinion being meshed with minute wheel 2.

More precisely, intermediate wheel and pinion 4 includes a wheel 49 meshing with pinion 9 of rotor 10 and a pinion 12 meshing with a wheel 11 carried by disconnectable wheel and pinion 5. The disconnectable wheel and pinion also includes a pinion 13 meshed with a third wheel 14 carried by third wheel and pinion 6, said third wheel and pinion 6 also carrying a pinion 50 which meshes with minute wheel 2. Moreover, as FIGS. 2 and 4 show, disconnectable wheel and pinion 5 is mounted so as to pivot on a stud 15 which is attached to lever 7 controlled by stem 8.

If FIGS. 1 and 3 are examined closely, lever 7 controlled by stem 8 is a strip 16 mounted so as to pivot on the shaft about which intermediate wheel and pinion 4 rotates. The end 17 of this lever 7 is turned up like a nose in order to co-operate with stem 8 or more precisely with knob 31 of said stem. The other end 18 of this same lever 7 has a thin part to form an elastic portion which rests on a nib 19.

Thus, as all the parts present have been described, the manner in which the disconnecting device operates can now be explained.

When time-setting stem 8 is set in its first pushed in neutral position 20 (FIGS. 1 and 2), end 17 of lever 7 is engaged in a groove 51 which follows knob 31 of the stem. Strip 16 of lever 7 then rests against a nib 52, biaised by elastic portion 18 of lever 7. In this situation, disconnectable wheel and pinion 5 is meshed both with intermediate wheel and pinion 4 and third wheel and pinion 6. Motor 3 then actuates hour hand 23 and minute hand 22 of the timepiece.

When stem 8 is arranged in its second pulled out position 21 (FIGS. 3 and 4), end 17 of lever 7 mounts knob 31 of the stem and causes strip 16 to pivot in the direction of arrow A about the shaft supporting intermediate wheel and pinion 4, while bending elastic portion 18 of lever 7. In this configuration, disconnectable wheel and pinion 5 becomes disconnected from third wheel and pinion 6—more precisely pinion 13 of disconnectable wheel and pinion 5 becomes disconnected from third wheel 14—while wheel 11 thereof remains meshed with pinion 12 of intermediate wheel and pinion 4. Thus train 1 includes a wheel and pinion able to be disconnected from at least one of the other wheel and pinions, but it will be understood that another arrangement could cause the disconnectable wheel and pinion to be disconnected from each of the neighbouring wheels and pinions. Whatever the arrangement hour hand 23 and minute hand 22 are kept stopped which allows stem 8 to co-operate with the motion work to proceed to the time-setting of the hands.

The aforecited EP-B-0 261 243 also discloses a disconnecting device which is made by inclining the third wheel. Not only does this mechanism take up a lot of space in height, it can, during re-engaging, lead to an error of plus or minus a half minute on the minute hand display. Conversely, the disconnecting device described hereinbefore does not take any space in height since there is only translation of one wheel and pinion. Moreover, the disconnected wheel and pinion is not the third wheel, but a wheel and pinion situated upstream, which reduces by at least ten times the display error during re-connecting.

Driving the second hand

Figure 5:
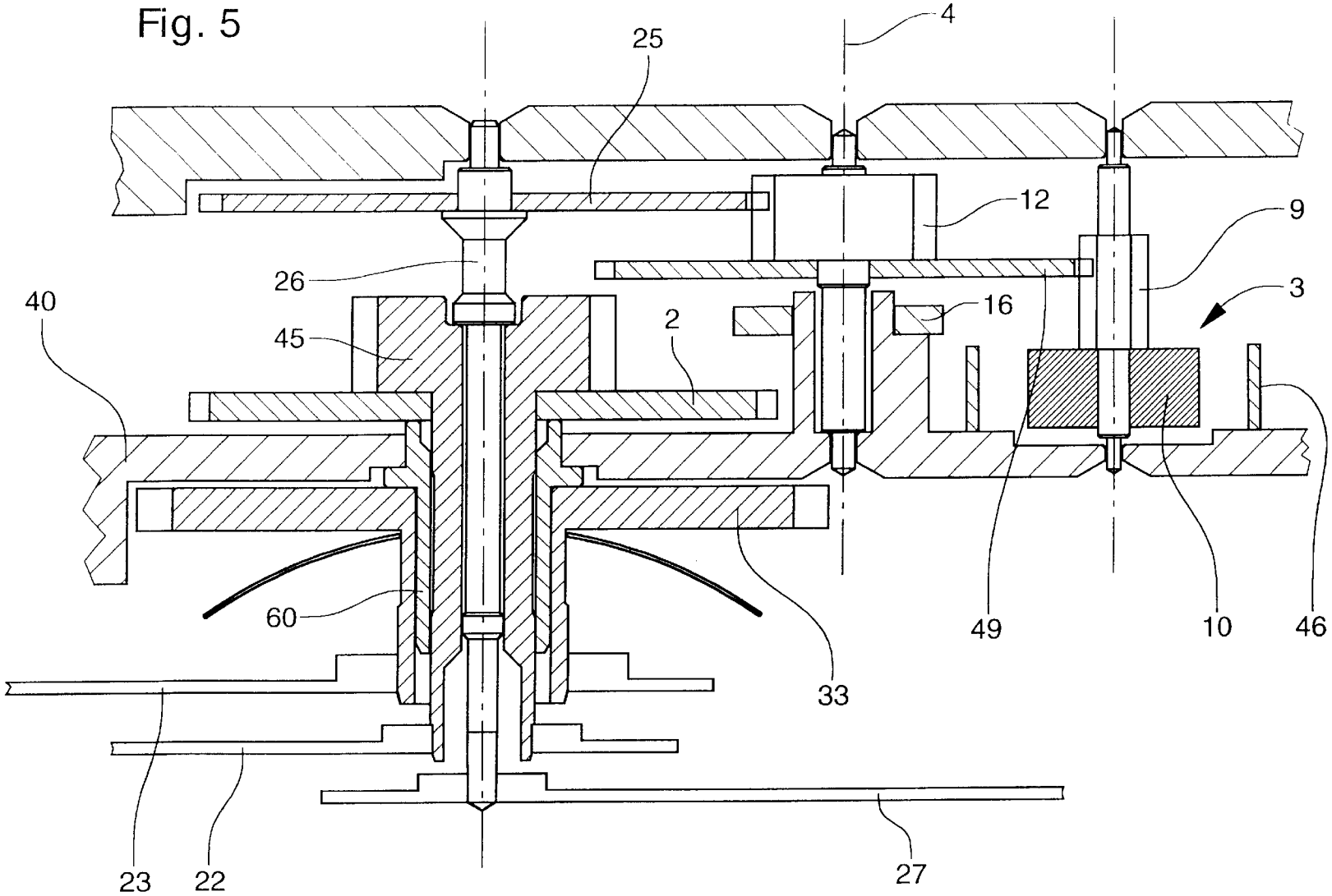
FIG. 5 is a cross-section along the line V—V of FIGS. 1 and 3.

The movement described hereinbefore provides a second display. As is shown in FIG. 5, pinion 9 which is situated on magnet 10 of motor 3 meshes with wheel 49 of intermediate wheel and pinion 4 as was already seen hereinbefore for driving gear train 1. In addition to wheel 11 of disconnectable wheel and pinion 5 (FIGS. 1 to 4), a second wheel 25, which drives by its shaft 26 a second hand 27, also meshes with pinion 12 of intermediate wheel 4. Cannon-pinion 45 passes through a central tube 60, driven into plate 40, which is topped by cannon wheel 33. At the moment of time-setting of minute hand 22 and hour hand 23, second hand 27 continues to display the seconds. As an alternative, this hand could be stopped electrically if a switch is installed on the stem.

What is claimed is:

1. A time-setting device for a timepiece comprising an hour hand and a minute hand, said device including a time-setting rotating stem capable of being set, via a crown topping one of its two ends, in a first neutral pushed in position and in at least a second pulled out position for which the stem co-operates with a motion work comprising a wheel and a pinion to allow time-setting of the hour and minute hands, the other end of the stem being arranged to rest on a peripheral zone of the motion work wheel when the stem is pulled out in the second position, the motion work wheel then being able to be driven only by friction between said other end and said peripheral zone, when the stem is actuated in rotation.

2. A time-setting device according to claim 1, wherein the other end of the stem has a knob able to rest on an annular flange made in the peripheral zone of the motion work wheel, and wherein said knob and said flange are untoothed.

3. A time-setting device according to claim 2, wherein when the stem is set in the second pulled out position, the knob actuates a lever which interrupts the time advancement of the hour and minute hands by uncoupling a wheel and pinion inserted in a gear train connecting a motor to a minute wheel included in the timepiece.

4. A time-setting device according to claim 2, wherein the motion work wheel meshes with a cannon-pinion carrying the minute wheel and the minute hand, wherein the motion work pinion meshes with a cannon wheel carrying the hour hand and wherein, when the stem is actuated in the second pulled out position, the knob of the stem raises the motion work wheel against the return force of a spring, the motion work wheel and the motion work pinion remaining meshed with, respectively, the cannon-pinion and the cannon wheel.

5. A time-setting device according to claim 4, wherein the return spring rests on a shaft of the motion work.

6. The time-setting device according to claim 1, wherein said other end and said peripheral zone are free of gear teeth in an area in which said other end rests on said peripheral zone.

* * * * *